United States Patent [19]

Liesveld

[11] 4,111,490

[45] Sep. 5, 1978

[54] METHOD AND APPARATUS FOR CHANNEL CUTTING OF HARD MATERIALS USING HIGH VELOCITY FLUID JETS

[76] Inventor: Daniel J. Liesveld, 6016 Newcombe St., Arvada, Colo. 80004

[21] Appl. No.: 610,577

[22] Filed: Sep. 5, 1975

[51] Int. Cl.[2] ..... E21C 25/60

[52] U.S. Cl. ..... 299/17; 239/101

[58] Field of Search ..... 299/17; 239/101, 1

[56] References Cited

U.S. PATENT DOCUMENTS

| | | | |
|---|---|---|---|
| 3,554,602 | 1/1971 | Chaney | 299/17 |
| 3,729,137 | 4/1973 | Cobb et al. | 299/17 X |
| 3,796,371 | 3/1974 | Taylor et al. | 299/17 X |
| 3,857,516 | 12/1974 | Taylor | 299/17 X |
| 3,883,075 | 5/1975 | Edney | 239/101 |
| 3,960,407 | 6/1976 | Noren | 299/17 |

FOREIGN PATENT DOCUMENTS

| | | | |
|---|---|---|---|
| 52,813 | 7/1965 | Poland | 299/17 |

*Primary Examiner*—Ernest R. Purser

*Assistant Examiner*—William F. Pate, III

*Attorney, Agent, or Firm*—John E. Reilly

[57] ABSTRACT

A high pressure fluidic medium is passed through a multiplicity of concentrating nozzles. The nozzles are rigidly retained within a frame or housing which directs the high velocity fluid flow columns therefrom against the surface of the material to be cut so that the area of impingement for each column is spaced from the others. The nozzle housing assembly preferably is held fixed for each channel cut pass but can be oscillated in a direction normal to the material surface while being moved along a line spaced from but parallel to the surface of the material to be cut. The areas of impingement of the fluid flow columns from the nozzle are arranged to erode cutting lines or kerfs along the material parallel to each other so as to define a total cut slightly greater than the width of the nozzle housing assembly. After a channel cut has been completed, the nozzle housing assembly is lowered towards the channel cut by a controlled increment and a further channel cut line is eroded until the desired cutting depth is obtained.

16 Claims, 13 Drawing Figures

METHOD AND APPARATUS FOR CHANNEL CUTTING OF HARD MATERIALS USING HIGH VELOCITY FLUID JETS

BACKGROUND OF THE INVENTION

The present invention relates to apparatus and methods for cutting relatively hard materials by use of high velocity, concentrated fluid jet streams. More particularly, the present invention relates to apparatus and methods for producing channel cuts in relatively hard materials by use of concentrated high velocity, fluid jet streams directed substantially normal to the surface of the material to be cut so that selected material is removed by an erosion process. The present invention is especially useful in performing cutting operations on hard materials such as stone and minerals although it is likewise useful for cutting softer materials such as wood, fabrics and the like. A particularly attractive application for the present invention relates to the use thereof in conjunction with stone quarrying or similar operations.

The problem of how to cut through extremely hard materials has been vexatious to mankind literally for centuries. Structures of various sorts have been constructed entirely from stone readily available in many geographic locations. The inconvenience of locating such stone in appropriately sized blocks for this purpose has required development of various techniques for severing the stone into preferred configurations. Extremely hard stone such as granite is particularly attractive for structural purposes since it provides a more durable resulting structure.

More recently developed materials such as concrete products and the like have found widespread usage as structural elements. The strength and hardness of such materials have likewise presented a cutting problem. Particularly where relatively thick workpieces must be cut, the cutting problem is akin to the problems encountered in quarrying of stone.

A series of developments have been produced for the purpose of cutting through various thick hard elements. For instance, jackhammers, diamond bit drills, blasting powder and the like have been regularly applied to stone quarrying. The resulting product frequently fails to conform to the intended configuration and further involves various inherent safety risks from its usage. Similar hazards as well as additional expense have been entailed in other cutting developments such as burner and wire saws; and these and other devices presently available in many cases have proven to be time-consuming and incapable of accurately forming narrow cuts in stone products.

One arrangement for explosively cutting thick materials has been suggested in U.S. Pat. No. 2,578,243 by Sweetman which employs detonation of an explosive charge to produce a high velocity gas column which is focused to effect a cutting operation. However, such devices are expensive and hazardous in use. It has likewise been suggested that high velocity fluid flow can be used for cutting hard materials as shown in U.S. Pat. No. 2,985,050 by Schwacha wherein a high pressure source of oil is concentrated into a high velocity stream and impinged against the surface of the material to be cut. The cutting qualities of such a procedure have been enhanced by adding abrasive material to the fluidic source. Durable flow concentrating nozzles useful in such high velocity cutting techniques have also been developed such as that shown in U.S. Pat. No. 3,756,106 by Chadwick et al.

Despite the many improvements in hard material cutting processes, there has been a continuing need for means of making relatively narrow, closely controlled cuts through thick sections of hard materials in a rapid manner which is environmentally compatible and employs apparatus which is readily transportable, of minimal cost and safe to operate. The lack of such apparatus and relatively high cost of available cutting apparatus are believed to have been a significant factor in the decline in stone products for structural purposes in recent years.

SUMMARY OF THE INVENTION

The present invention makes it possible to controllably cut a wide variety of materials of differing hardness and further for cutting such materials over a wide range of thicknesses or depths accurately and in a minimum of time. In accordance with the method and apparatus of the present invention, a high pressure hydraulic fluid medium source is employed to deliver fluid under amplified pressure to a plurality of nozzles, each of which concentrates the fluid medium into an extremely high velocity fluid column. The nozzles are arrayed in a housing frame so that the fluid columns therefrom impinge against the surface of the material to be cut at spaced locations in a direction transverse to the intended line of cut. That is, the fluidic flow column of each nozzle is directed normal or substantially normal to the surface of the material to be cut so that linear movement of the mounting frame in spaced relation to the surface of the material will result in a series of kerfs along the intended line of cut with these kerfs being in sufficiently close parallel relation to one another as to effectively crush the impacted workpiece materials and erode a common, continuous channel into the material. By maintaining the kerfs in close relation, pinnacling can be avoided by erosion between the immediate impact areas.

A nozzle mounting assembly can be moved along a given line so as to cut a channel of a specified depth as a first pass. Thereafter, the nozzle mounting assembly can be moved toward the channel and another depth of cut produced thereby deepening the channel. By arranging the areas of impingement for the fluid flow columns so that they erode a channel slightly wider than the nozzle mounting housing such as by arraying the nozzles so as to produce a fan-like pattern transverse to the line of cut, this process can be continued until a desired depth of cut is produced which can be for an extended range of thickness of material. Channel cuts with smooth sidewalls can be obtained using the fan-shaped pattern by continuously oscillating or reciprocating the nozzle mounting assembly along a line normal to the surface of the workpiece. Further, the nozzle mounting assembly can be pivoted so as to impinge against the surface in any angular direction relative to the drive assembly and, in fact, the cutting head can be remotely positioned from the main power source itself.

Accordingly, this invention is anticipated as being particularly attractive to the quarrying industry since low cost cutting of thick but hard or dense stone materials can be achieved which is extremely accurate and efficient in use. By using water or other hydraulic fluid medium for cutting, the cost can be kept to a minimum and further be environmentally compatible and safe.

An object of this invention is to provide a novel and improved method and apparatus for cutting through a variety of materials of differing hardness and depths.

A further object of this invention is to provide a novel method and apparatus for cutting controlled narrow channels of desired depths into a workpiece by an erosion process.

Another object of this invention is to provide a novel method and apparatus for employing high velocity fluid jets for cutting controlled narrow channels of selected depths into hard materials.

A still further objects of the present invention is to provide a novel method and apparatus for inexpensive but controlled cutting of workpiece materials in a manner which is environmentally compatible.

Yet another object of this invention is to provide a novel method and apparatus for cutting hard materials such as stone, concrete products or the like by use of high velocity concentrated fluid flow for selective material removal by erosion.

The foregoing and other objects, features and advantages of the present invention will be readily apparent in view of the following description of an exemplary preferred embodiment.

DETAILED DESCRIPTION OF THE PREFERRED EMBODIMENT

Figure 1:
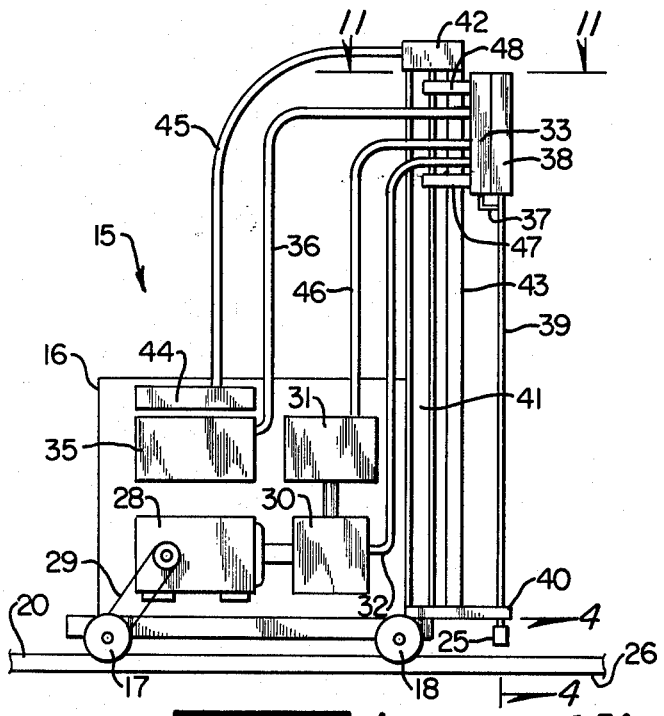
FIG. 1 is a partially schematic side view of a fluid jet cutting device in accordance with the preferred embodiment.
Figure 2:
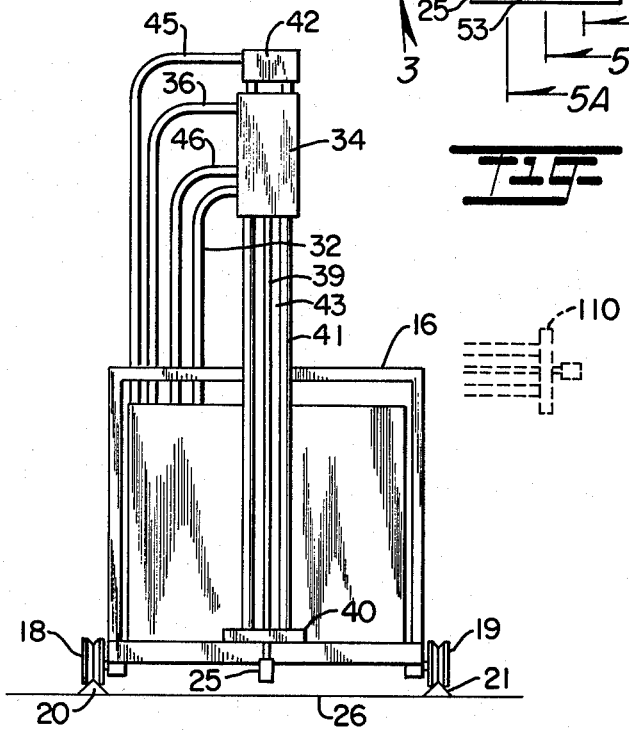
FIG. 2 is a front view of the preferred embodiment illustrated in FIG. 1.

A substantially self-contained fluid jet cutting system 15 is shown in partially schematic form in side view in FIG. 1 and in front view thereof in FIG. 2. A main housing 16 is mounted for movement on four V-grooved wheels such as 17–19 arranged to be guided by rails 20 and 21. A nozzle mounting housing assembly 25 to be described in greater detail later is positioned in proximity to the surface of the material to be cut or workpiece 26 and is movable along the desired line of cut by an electric motor 28 which is coupled by a belt drive 29 to one or more of the guide wheels such as 17. The speed of movement of main housing 16 is preselected to accommodate the cutting speed of the jets retained within housing 25.

As will be described below, the high velocity fluid column cutting jets discharged from the nozzles in housing 25 are spaced for impingement upon the surface of the workpiece 26 at relatively constant but shallow angular displacements from a vertical axis. The fluid pressure applied to the nozzles and the horizontal velocity of main frame 16 is a function of the particular materials being cut. Motor 28 is additionally coupled for driving a hydraulic oil pump 30 which receives oil from reservoir 31 and introduces it via flexible hose 32 into an intensifier 33. This oil is returned to reservoir 31 over line 46. Such intensifiers which produce a relatively high output pressure in response to a low input pressure are commercially available. Preferably, the oil is produced by pump 30 into feed line 32 for intensifier 33 at a relatively high pressure such as 5,000 psi and intensifier 33 is typically capable of pressure increase or amplification in the range of a 12 to 1 ratio. Accordingly, intensifier 33 receives the 5,000 psi oil in the low pressure chamber thereof which drives a piston in the high pressure chamber. Water from tank 35 is introduced to intensifier 33 over flexible hose connection 36 and fed to the high pressure input portal thereof. Thus, the water produced at the output of intensifier 33 at line 37 may be in the order of 60,000 psi.

The high pressure water at intensifier output line 37 is coupled to accumulator 38 which eliminates surging in the well-known manner and provides the system with a relatively constant output pressure of 60,000 psi at feed line or lines 39 for the nozzle mounting assembly 25. Check values can be included within lines 39 if desired. Although system 15 is shown with an internal water reservoir source 35, it will be readily recognized that the water supply can be from any suitable source for coupling into feed line 36. The intensifier 33 and accumulator 38 as illustrated in FIG. 1 are typically mounted within a unitary housing 34 as shown in FIGS. 2 and 11.

As will be more fully appreciated from subsequent descriptive detail, the nozzles contained within mounting housing 25 preferably cut a channel which has a width greater than the width of housing 25. That is, as seen by the bottom view of housing 25 in FIG. 6, the left and right ends of housing 25 are at least slightly narrower than the width of the channel cut even though the horizontal length of housing 25 in FIG. 6 can be considerably greater than its width. Therefore, passage of system 15 over a preselected horizontal cut line can be followed by lowering of housing 25 by a suitable increment and retracing the channel cut line so as to increase its depth. The feed line or lines 39 for cutting head assembly 25 are slidably retained in a vertical orientation via a suitable collar arrangement in lower platform 40. An I-beam channel 41 is rigidly attached along the front of main frame 16 and has a suitable drive motor 42 rigidly attached to the top thereof for rotating elongated screw 43. Drive motor assembly 42 is coupled to a suitable power source 44 via flexible connector 45. Note that power source 44 can be an electric source for an electric motor in 42 or an additional fluid pump arrangement coupled for selectable energization by electric motor 28. The hydraulic oil return line 46 to reservoir 31 could likewise be used for hydraulic oil return from drive motor 42 if a hydraulic system is selected. The worm gear 43 is suitably retained within bearing housings at both lower platform 40 and the upper motor drive assembly housing 42.

Figure 11:
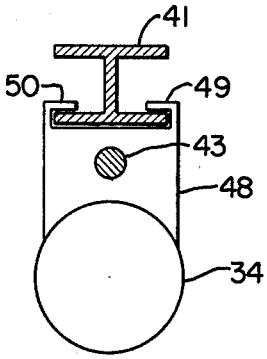
FIG. 11 is a partially sectioned view showing the mounting arrangement for the intensifier and accumulator housing of FIG. 1 taken along lines 11—11 thereof.

The retaining arrangement for housing 34 containing accumulator 38 and intensifier 37 is shown in greater detail in the section view of FIG. 11 taken along lines 11—11 of FIG. 1. The housing 34 contains upper and lower guide elements 47 and 48. At least one of guides 47 and 48 contains a bore therethrough with a threaded inner wall for engaging worm gear 43. Both guides 47 and 48 have a pair of guide ears 49 and 50 which envelope the edges of one side of I-beam 41 to prevent rotation of housing 34 while permitting vertical movement thereof in response to rotation of worm gear 43.

The channel cutting machine 15 is thus effectively mounted on a vehicle 16 with V-wheels 17–19. The car is propelled along the V-tracks 20 and 21 by motor 28 thereby controlling the horizontal cutting action. Vehicle 16 can further include controls to vary the vertical positioning action via drive motor assembly 42 as well as the reciprocal action of horizontal cutting. Thus nozzle assembly 25 can be raised and lowered for vertical control and also moved in a horizontal direction along the intended line of cut. Furthermore, vehicle 16 can include suitable apparatus capable of being pre-programmed for particular cutting sequences. By way of example, these programmed controls can energize the jets in head 25 and cause vehicle 16 to move over rails 20 and 21 for a preselected distance. head 25 is then moved downward by a suitable increment followed by a retracing of the preselected horizontal distance. Such cycles of horizontal and vertical movement can be repeated as often as needed for the desired total depth of cut.

The channel nozzle assembly 25 is engineered to produce jets having precise angles of impingement upon the surface of the workpiece 26 and exact spacing within housing 25. Controlled pressure and regulated traverse speeds are available through the self-contained mechanism shown in FIGS. 1 and 2. That is, the jet spacing and impingement angle is constant but the pressure and traverse speed can be varied in selection with the particular qualities of the material being cut. As mentioned, the water from source 35 is ultimately produced at feed lines 39 at 60,000 psi and the nozzles contained within housing 25 each might typically produce a fluid flow column of 3,000 feet per second. Granite has a crushing strength between 20,000 and 35,000 psi so that crushing and erosion does take place and at a rapid rate when the granite is in the direct path of the fluid flow columns from the jets.

As shown in detail in FIGS. 3–6, six jets from nozzles 51–56 impinge upon the surface of the workpiece 26 so that six parallel kerfs are realized. Pinnacles between these kerfs are severed by maintaining minimal spacing between these kerfs. That is, pinnacle severance takes place because crystals of the workpiece are loosened as the jets work downwardly into the material and the loosened particles are flushed out of the channel by the fluid flow. The crystals break down on their planing which further helps break down the side walls of any pinnacles.

Figure 3:
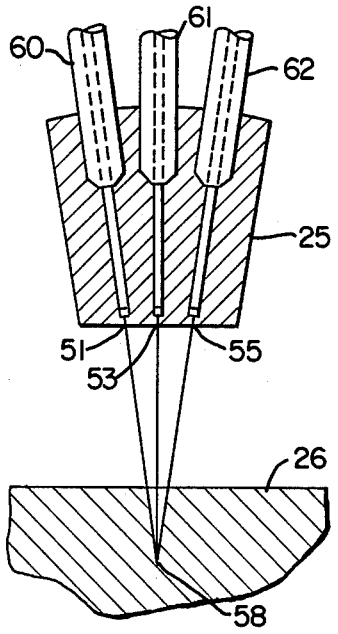
FIG. 3 is a section view of the mounting housing for the nozzles taken along lines 3—3 of FIG. 6.
Figure 4:
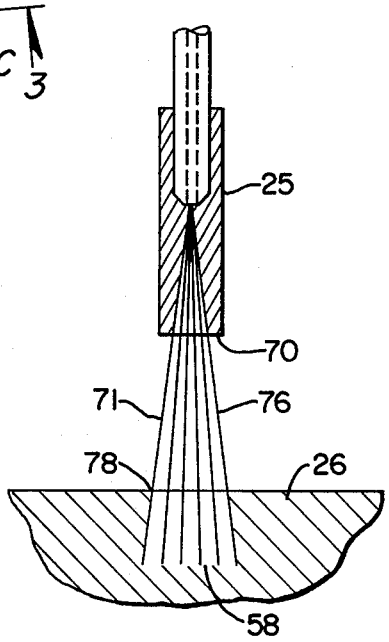
FIG. 4 is a somewhat schematic section view of the nozzle mounting housing assembly taken along lines 4—4 of FIG. 1 particularly showing the fan-shaped pattern produced by the nozzles in a direction transverse to the line to cut.

With the jets from nozzles 51–56 precisely angled, spaced, pressured and timed, a completely free channel is obtained with no obstruction in the path of the nozzle assembly 25. This results because the nozzle is designed such that the jets diverge from the assembly 25 to form a channel wider than the nozzle assembly itself. The fanning orientation of these jets is effective for a limited distance as shown in FIG. 4 and controlled by the traverse speed. Further, the jets from nozzles 51–56 are angled towards a common line perpendicular to the line of cut as is shown generally in FIG. 3.

The assembly traverses at a speed so that the depth of cut 58 is preferably about ½ inch. After completion of one traverse, vertical drive motor 42 is actuated and the housing 25 thereby lowered ½ inch. The horizontal traversing is reversed and the channel can be completed to depths determined by the number of such half-inch depth cutting passes. The channel is maintained in a straight line by the guiding assembly and housing so that the nozzle assembly 25 can travel within the confines of the previously cut channel. The nozzle fluid flow columns 71–76 diverge as shown in FIG. 4 to form the width of the channel at 58 but the jets are directed to converge in the other direction as shown in FIG. 3 to form a concentrated straight line with one jet helping the other to break down and remove crystals in the pinnacle areas between kerfs. The nozzles in assembly 25 are preferably of durable materials such as sapphire to insure long life and dependable coherent jets. The mounting block 25 for the nozzles is formed as a manifold of stainless steel which is machinable and yet sufficiently strong to withstand pressures.

By using the method and apparatus of the present invention as described to this point, the channel sidewalls after cutting will be relatively smooth and suitable for appropriate finishing by known techniques.

However, an even smoother sidewall can be produced in accordance with this invention by rapidly reciprocating nozzle assembly 25 along a line perpendicular to the surface of the workpiece as it is being moved parallel to the intended line of cut. This result can be obtained by cyclically energizing vertical positioning means for nozzle assembly 25 such as by motor 42 or by additional reciprocating means so that nozzle assembly 25 moves up and down at least once by an amount equal to the channel depth for each increment of movement of assembly 25 parallel to the intended line of cut. As seen in FIG. 4, the resulting channel would have vertical sidewalls parallel to one another from the upper opening to the bottom with a separation as shown at 58. For example, assume that as shown in FIG. 4 lower surface 70 of nozzle assembly 25 in 1 inch above the upper surface of workpiece 26 when a cut of ½ inch depth is made to the bottom surface 58 of the channel. If it is desired to cut a channel with sidewalls separated by a uniform width the same as at 58, nozzle assembly 25 is moved upwards and downwards along a line perpendicular to the surface of workpiece 26 so that the spacing between surface 70 and the workpiece surface cyclically varies between 1.0 inches and 1.5 inches with at least one such vertical cycle being accomplished for each increment of horizontal. This horizontal travel increment is roughly equivalent to the cross-sectional area of the fluid jet columns.

Figure 6:
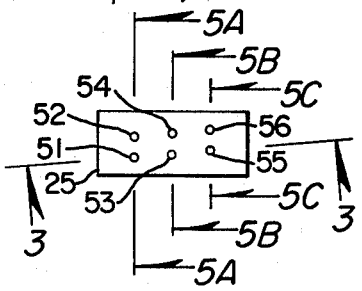
FIG. 6 is a bottom view of the nozzle mounting frame assembly.
Figure 5A:
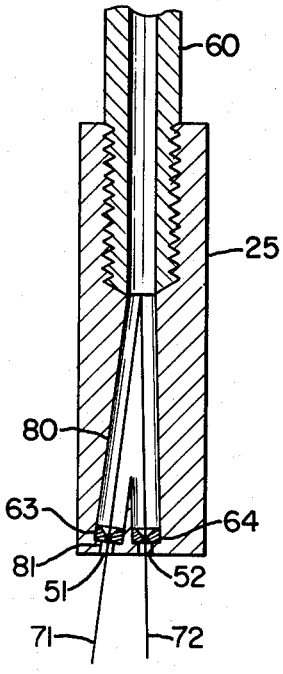
FIG. 5 is a series of section views showing typical mounting arrangements for the three nozzle pairs within the housing frame for producing the dispersed column pattern shown in FIG. 4.
Figure 5B:
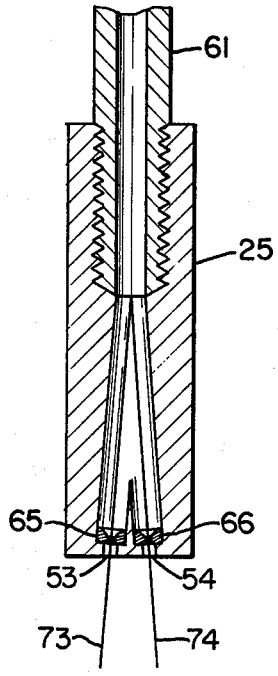
Figure 5C:
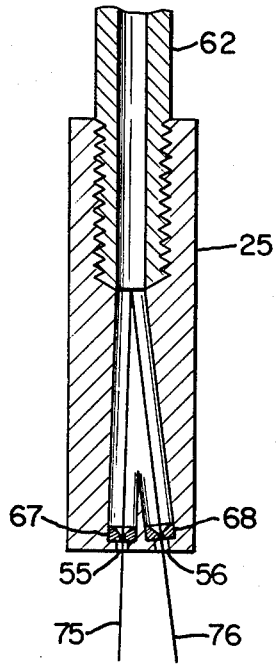

FIG. 5 presents three section views taken along lines 5A—5A, 5B—5B and 5C—5C in FIG. 6 and shows the mounting and orientation of the sapphire nozzles. The high pressure output 39 of FIGS. 1 and 2 from intensifier 33 and accumulator 38 is coupled into stainless steel tubes 60, 61 and 62 each of which supplies high pressure fluid to a pair of nozzles. The sapphire nozzles retained in the ends of the chambers of the manifold 25 are shown at 63–68 in FIGS. 5A–5C. As are known in the art, such nozzle concentrators are formed of a generally conical inner area introducing the fluid from the entry port at the opening of this conical area into a generally cylindrical orifice.

As is most readily seen in FIG. 4, the fluid flow columns produced by nozzles 63 and 68 into the exit orifices 51 and 56 have the greatest distance to travel in producing the channel cut. Accordingly, nozzles 51 and 56 via sapphire concentrators 63 and 68 are arranged to have a larger diameter than the other nozzles since the erosion work required thereby is at a slightly greater distance and slightly greater angle to the workpiece surface than the other nozzles. As a typical example, the exit orifice for sapphire nozzles 63 and 68 is 0.013 inches in diameter while the exit nozzles for sapphire nozzles 65 and 66 are 0.012 inches in diameter and sapphires 64 and 67 are 0.011 inches in diameter. With the previously mentioned pressures and the typical diametric dimensions mentioned above, the water expulsion rate is approximately 6.6 gallons per minute.

Referring again briefly to FIG. 3, feed tubes 60–62 typically are ¼ inch stainless steel tubing threaded for attachment into mounting block or manifold block 25 which is likewise fabricated or machined from stainless steel. Tube 61 is oriented perpendicular to the surface of workpiece 26 in the direction of the line of cut whereas tubes 60 and 62 are at approximately an 8° displacement from tube 61. The front face of manifold block 25 is preferably positioned 1 inch above the surface of workpiece 26 and the depth of cut is typically about ½ inch for this configuration. As seen in the transverse section view of FIG. 4, the fluid flow columns 71–76 form a fan pattern of about 15° total with about 3° separation therebetween. Accordingly, with lower surface 70 of head 25 held one inch above the initial cut entry point at 78, the cut opening for the channel at 78 is approximately ½ inch in width and fans outwardly to about ⅝ inch at the base of the channel 58. By employing a width of manifold block 25 of 7/16 inches, the entire manifold and nozzle assembly can be fed downwardly into the channel through opening 78. The clearance between manifold block 25 relative to the channel sidewalls as well as the smoothness of the channel sidewalls can be improved by the rapid reciprocal vertical movement of block 25 during movement along the line of cut as described above. This cycling of block 25 over half inch increments perpendicular to the line of cut results in a channel 0.5 inches deep with a uniform ⅝ inch width.

Each manifold passage such as 80 shown in FIG. 5A is preferably 0.080 inches in diameter. The sapphire orifice jewels such as 63–68 are preferably 0.078 inches in outside diameter with Lok-Tite sealant retaining them in place. The exit orifices of jewel blocks 63–68 are varied between 0.011 and 0.013 inches as mentioned above and the opening channels such as 81 in FIG. 5A is preferably 0.030 inches in diameter so as to retain the jewel block in place but avoid any impedance to the fluid flow column from the jewel blocks.

To effect the 15° fan spacing for the fluid flow column 71–76, the structure is arranged so that column 71 is 7½° to the left of vertical as seen in FIG. 5A while column 72 is 1½° to the right of vertical. The columns 73 and 74 of FIG. 5B are 4½° to the left and right of vertical, respectively. The column 75 of FIG. 5C is 1½° to the left of vertical while column 76 is 7½° to the right. This orientation of columns 71–76 effects the result of 3° separation between such columns as schematically shown in FIG. 4. The cutting head shown in FIGS. 3–6 when employed with six sapphire orifice jewel nozzles 63–68 typically employs a 225 horsepower drive motor to produce the 60,000 psi feed fluid and consumes 6.6 gallons of water per minute.

Note that a ⅜ inch wide manifold could be used and include only five appropriately oriented and spaced jets with effectively the same result.

Figure 7:
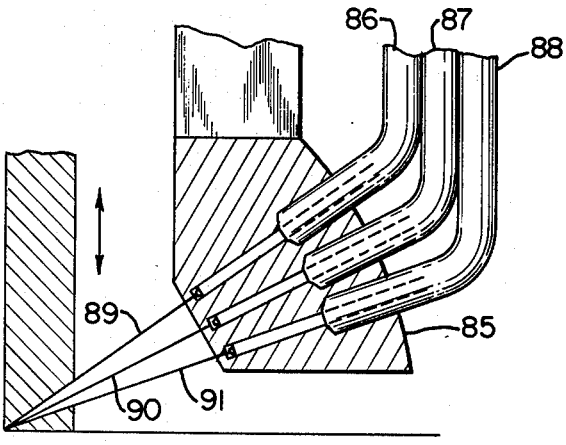
FIG. 7 illustrates an alternative nozzle mounting housing assembly particularly useful for vertical cutting of materials.

FIG. 7 shows a potential alternate embodiment for the nozzle mounting assembly particularly useful for vertical cuts. Manifold mounting block 85 has three feed lines 86, 87 and 88 coupled to jewel block concentrator nozzles similar to those mentioned previously. Thus, fluid flow columns 89, 90 and 91 can be angled to provide a vertical cut as generally illustrated in FIG. 7.

Figure 10:
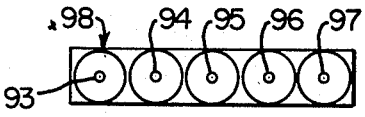
FIG. 10 is a bottom view of the FIG. 8 housing assembly.
Figure 8:
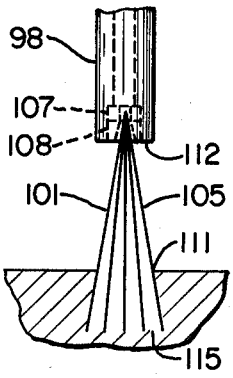
FIG. 8 is an end view of a further alternative housing assembly for channel cutting nozzles.
Figure 9:
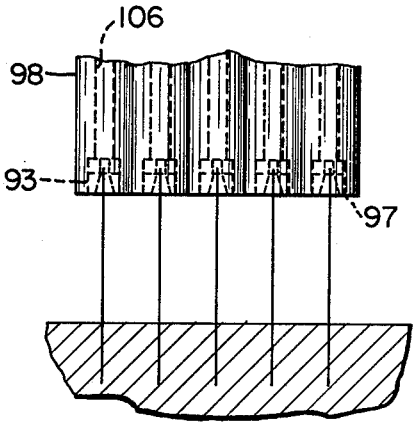
FIG. 9 is a side view of the FIG. 8 nozzle housing assembly.

FIGS. 8–10 illustrate yet another alternate nozzle assembly mounting configuration. This cutting head 98 uses five jewel nozzle insert assemblies 93–97 retained within the ends of five stainless steel tubes by a suitable collar, mounting block or the like in the orientation illustrated in FIGS. 8–10. Each nozzle assembly 93–97 is oriented so as to impinge a fluid flow column 101–105 in the fan pattern perpendicular to the line of cut as shown in FIG. 8. Typically, jet column 101 is displaced 10° to the left of vertical as column 105 is displaced 10° to the right. Intermediate columns 102 and 104 are displaced by 5° on either side of vertical while middle column 103 produced by nozzle 95 in vertical. Nozzles 93 and 97 have a 0.013 inch diameter opening while nozzles 94 and 96 have a 0.012 inch opening and nozzle 95 has a 0.011 inch opening. The inside diameter of the feed passageways such as 106 shown in FIG. 9 are 0.125 inches with the outside diameter of each sapphire jewel nozzle for assemblies 93–97 being 0.078. The ⅜ inch stainless steel tubes require a 185 horsepower drive motor with a consumption rate of 5.5 gallons per minute. In the version shown in FIGS. 8–9, each jewel block assembly 93–97 includes a retaining internal insert 107 which is further held in place by a block 108 threaded into the end of each column to hold the nozzle block in place. The cutting depth from 111 to 115 is preferably ⅜ inch with the lower surface 112 of head 98 being held 1 inch above the entry point 111 of the cut.

Note that the mounting column structure for block 25 shown in FIGS. 1 and 2 can be pivotally mounted to the main frame 16 so that it can be oriented for angled or side cuts. Thus, a right angle or horizontal cut can be realized by positioning block 25 and its support structure as shown in phantom at 110 in FIG. 2 and a cut into a perpendicular surface obtained. Note also that the cutting head assembly 25 can be remoted from the other structure if desired rather than attaching it as an integral unit as shown in FIGS. 1 and 2. Under such circumstances, it is preferable that intensifier 33 and accumulator 38 be likewise remoted with head 25 since flexible lines for high pressure feed 39 generally should be avoided.

Reviewing the operation of a cutting function using a vehicle mount along the lines of that shown in FIGS. 1 and 2, the desired channel cut location is determined and guide rails 21 and 21 positioned in relation to that cut. The vehicle 16 is placed so that the cutting head manifold block 25 is located at the initial point of cut and the cutting operation started by introducing high pressure water to the jet nozzles as discussed above. The vehicle is powered to move forwardly at a preselected rate so that an elongated channel cut is obtained. For more uniform spacing and smoother surfacing of the channel sidewalls, the block 25 is rapidly cycled through a movement perpendicular to the workpiece surface by an increment equal to the channel cut depth. Preferably, this cut is of about ½ inch depth and the entire channel is traversed for one pass. The vehicle by either separate controls or by automated controls can then move the manifold block 25 vertically downward by ½ inch and the motor drive reversed to re-traverse the cutting channel and cut a further ½ inch increment in depth therein. These passes are repeated and the positioning vertically for head 25 continuously moved downward until the final desired vertical cut distance is obtained.

The present invention is especially useful in a plant for operating as a saw. For instance, large blocks can be sawed into slabs of various thicknesses. The cutting rate for granite is approximately 40 square feet an hour at a cost of about one-fourth of present cutting techniques. With both ends of the workpieces block open, a nozzle in accordance with FIG. 3 and the aforementioned dimensional data and relationships can typically be used. The machine traverses back and forth over the block at about 3 inches per second and cuts straight down to a ½ inch depth per traverse. The nozzle cuts in both traverse directions and is lowered automatically. In cutting marble or limestone, the traverse speed is doubled. Smoother, more evenly spaced channel sidewalls can be obtained by reciprocating block 25 along a line perpendicular to the line of cut for a distance of ½ inch at a rate of 150 to 600 cycles per second.

In a quarry or other immediate work site, the machine is likewise useful as a channeler or saw. Nozzles in accordance with FIG. 7 can be used. A typical depth of cut might be 7 feet average. If the quarry is benched and one end is open, the nozzle starts at the top cutting the end to the 7 foot depth in a vertical lowering of the nozzle. The machine then moves forward by the ½ inch cut depth increment and the nozzle cuts upward followed by another ¼ inch forward movement increment. Thus, the nozzle reciprocates up and down vertically with automatic guidance.

For a solid quarry floor with no benches or open ends, a hole such as 2½ inches in diameter suitable to accommodate the head, feed lines and support structure is drilled to the 7 foot depth such as by a jack hammer. The nozzle then reciprocates vertically in that hole and a channel is started. The channel will be 7 feet deep and of a length determined by the length of track or quarry. The supporting structure or shell for the nozzle is at least 7 feet high with appropriate guides for the nozzle and intensifier. That is, the intensifier and nozzle are preferably connected as a solid unit with stainless steel tubing and reciprocate together up and down the shell. This avoids the requirement of employing flexible tubing that can withstand the high pressures (60,000 psi) involved. The shell is movable on a quarry bar on the truck so that, after one channel is complete, the shell is moved laterally on the bar. One or more other channels can be made with one track setting. The shell and bar arrangement on the truck can be rotated so that a flat horizontal channel can be made in a solid vertical wall. This can be advantageous in a tunneling operation where horizontal bores are needed. Thus, this invention is especially useful for mining of coal, shale minerals, stone or other products as well as for tunnel construction purposes.

Although the present invention has been described with particularlity relative to the foregoing exemplary preferred embodiments, various changes, modifications, additions and applications other than those specifically mentioned hereinbefore will be readily apparent to those having normal skill in the art without departing from the spirit of this invention.

What is claimed is:

1. Apparatus for channel cutting through a workpiece comprising:

fluid supply means for producing a fluid medium under high pressure, a plurality of nozzles each capable of concentrating fluid introduced to an entry port thereof into a fluid column emanating from an exit orifice wherein said exit orifice is of a substantially smaller opening size than the opening size of said entry port, means coupling the high pressure fluid medium to said entry ports of said nozzles for generating fluid flow columns from said exit orifices, frame means for mounting said nozzles so that the flow columns thereof impinge at spaced locations on the surface of the material to be cut, the pressure of the fluid medium from said producing means being of a magnitude for erosively removing material from the workpiece in response to impingement thereon of the fluid flow column from said exit orifices including means for propelling said frame means along an intended line of cutting on the workpiece, and reciprocating means for cyclically moving said frame means along a line perpendicular to the surface of the workpiece including means for controlling said reciprocating means to reciprocate along said perpendicular line for a distance approximately equal to the intended depth of channel cut.

2. Apparatus in accordance with claim 1 which includes motive drive means for moving said frame in a line parallel to the surface of the workpiece, said frame means rigidly mounting said nozzles for simultaneously cutting parallel kerfs on the workpiece as said frame means is advanced by said drive means.

3. Apparatus in accordance with claim 2, said reciprocating means completing at least one cycle of perpendicular movement of said frame means for movement of said frame means in response to said motive drive means by an increment corresponding to the approximate cross-sectional distance of said nozzle flow columns.

4. Apparatus in accordance with claim 1 which further includes means for positioning said frame along an axis perpendicular to the surface of the workpiece, said frame means rigidly mounting said nozzles to form a divergent fluid column for providing a total width of the parallel kerfs on the workpiece greater than the width of said frame in a direction peripendicular to the cut line produced in response to motivation by said motive drive means and a convergent fluid column in a direction parallel to the cut line.

5. Apparatus in accordance with claim 1 wherein said frame includes a housing arranged for mounting said nozzles for directing the fluid flow columns therefrom in a fan-shaped pattern around a line normal to the surface of the workpiece, said frame further including means for retaining said housing and said nozzles in spaced relation to the surface of the area to be cut on a workpiece so that the outer said fluid columns of said fan pattern impinge upon the workpiece area at points corresponding to a width greater than the width of said housing.

6. Apparatus in accordance with claim 5 wherein said high pressure fluid producing means includes a pump for producing a relatively low pressure fluid output, a source of fluid medium, an intensifier coupled for receiving the fluid medium from said source, said intensifier being responsive to said pump output for applying pressure to said fluid medium at a pressure level which is a predetermined multiplication ratio of the fluid pressure output of said pump, and an accumulator coupled to the high pressure fluid medium output of said intensifier for dampening pressure fluctuations thereof.

7. Apparatus in accordance with claim 5 wherein the openings of said exit orifices for said nozzles forming the fan-shaped pattern are progressively larger as a function of the angular displacement of the fluid flow column thereof from a line normal to the surface area of the material to be cut.

8. Apparatus for channel cutting through or into a workpiece of relatively hard materials comprising:

a main frame, means for propelling said main frame along the intended line of cutting on the workpiece, means on said main frame for producing a hydraulic fluid medium under high pressure, a plurality of nozzles each capable of concentrating fluid introduced to an entry port thereof into a high velocity, coherent fluid flow column emanating from an exit orifice which has a smaller opening than said entry port thereof.

means for coupling the high pressure medium from said producing means to said nozzle entry ports, a manifold for retaining said nozzles so that the fluid flow columns therefrom simultaneously impinge on the surface area to be cut on the workpiece at spaced locations tranverse to the intended line of cut, and means attaching said manifold to said main frame in spaced relation to the area to be cut on the workpiece for directing the fluid flow columns from said nozzles in a fan pattern and in substantially normal orientation onto the workpiece area to be cut, the level of high pressure of the fluid medium from said producing means and the size of said exit orifices of said nozzles being selected for crushing and eroding the material of the workpiece impinged by the fluid flow columns while the rate of movement of said main frame along the intended cut line is selected for producing an elongated cut channel of a preselected depth, the sizes of said nozzle exit orifices being selected progressively larger depending upon the angular displacement of the fluid flow column produced thereby relative to a line normal to the surface area to be cut on the workpiece.

9. Apparatus in accordance with claim 8 which further includes means on said main frame for selectably moving said manifold along a line normal to the surface area to be cut on the workpiece.

10. Apparatus in accordance with claim 9 wherein said moving means includes means for cyclically moving said manifold along a line normal to the surface of the workpiece over a distance corresponding to the intended depth of channel cut so that one cycle of normal movement is completed for each increment of movement of said main frame equal to approximately the cross-sectional distance of said nozzle fluid flow columns.

11. Apparatus in accordance with claim 9 wherein the line of cut of said nozzle fluid flow columns on the workpiece is wider than the width of said manifold in a direction transverse to the intended line of cut.

12. Apparatus in accordance with claim 11 wherein said nozzles are retained in said manifold for producing kerfs on the workpiece which are spaced for eroding any workpiece material therebetween by lateral erosion.

13. The method of channel cutting through or into a workpiece along an intended line of cut comprising the steps of:

producing a fluid medium at a high pressure, concentrating the high pressure fluid into a plurality of fluid flow columns of a sufficiently high pressure for crushing and eroding the material of the workpiece when impacted in a direction substantially normal to the surface area to be cut on the workpiece, simultaneously impinging the fluid flow columns in spaced and substantially normal relation along a line on the area to be cut on the workpiece transverse to the intended line of cut, moving the fluid flow columns along a line parallel to the intended line of cut at a rate of speed for accommodating crushing and eroding of the workpiece material to a preselected depth, and continuously reciprocating the fluid flow columns along a line perpendicular to the surface of the workpiece by a distance corresponding to the intended depth of cut as said fluid flow columns are moved along each intended line of cut.

14. The method in accordance with claim 13 for cutting through or into a workpiece wherein the intended line of cut is of a predetermined length, said moving step including the steps of reciprocally moving the fluid flow columns over said predetermined length, said method further including the step of lowering the point of origin of the fluid flow columns along a line normal to the surface area to be cut by a distance equal to said preselected depth at the end of each said moving step.

15. The method in accordance with claim 14 wherein the fluid flow columns are produced from a plurality of nozzles, said method, further including the step of retaining said nozzles in positions for generating a fan-shaped pattern in a direction transverse to the intended line of cut.

16. The method in accordance with claim 15 wherein said concentrating step includes the step of generating a volume rate of fluid flow for the fluid flow columns which is progressively larger as a function of the angular displacement thereof relative to a line normal to the surface to be cut on the workpiece.

* * * * *